US006267538B1

(12) United States Patent
Caldwell

(10) Patent No.: US 6,267,538 B1
(45) Date of Patent: Jul. 31, 2001

(54) BEAM JOINING CAP FOR TRENCH SHIELD

(76) Inventor: Gary L. Caldwell, P.O. Box 302, Seffner, FL (US) 33583

( * ) Notice: Subject to any disclaimer, the term of this patent is extended or adjusted under 35 U.S.C. 154(b) by 0 days.

(21) Appl. No.: 09/520,033

(22) Filed: Mar. 6, 2000

(51) Int. Cl.[7] ..... E02D 17/04
(52) U.S. Cl. ..... 405/283; 405/282; 405/272
(58) Field of Search ..... 405/283, 282, 405/272

(56) References Cited

U.S. PATENT DOCUMENTS

| | | | | |
|---|---|---|---|---|
| 1,775,060 | * | 9/1930 | Bauer, Jr. | 405/272 |
| 3,212,270 | * | 10/1965 | Benintend | 405/272 |
| 4,090,365 | | 5/1978 | Nieber . | |
| 4,139,324 | | 2/1979 | Krings . | |
| 4,685,837 | | 8/1987 | Cicanese . | |
| 4,850,747 | | 7/1989 | Morelli . | |
| 5,154,541 | | 10/1992 | Boren et al. . | |
| 5,199,824 | * | 4/1993 | Smith et al. | 405/282 |

FOREIGN PATENT DOCUMENTS

2166774 * 5/1986 (GB) .

* cited by examiner

*Primary Examiner*—David Bagnell
*Assistant Examiner*—Sunil Singh
(74) *Attorney, Agent, or Firm*—Anton J. Hopen; Smith & Hopen, P.A.

(57) ABSTRACT

An apparatus for joining at least two or more wales of a shoring system including a first substantially rigid end-cap adapted to enclose an end of a first horizontally disposed wale, the first end-cap having a horizontally extending flange with a first vertically disposed aperture cut there through, a second substantially rigid end-cap adapted to enclose an end of a second horizontally disposed wale, the second end-cap having a horizontally extending flange with a second vertically disposed aperture cut there through of substantially the same diameter of the first vertically disposed aperture, a locking pin dimensioned to be slideably received by the first and second vertically disposed apertures when the first and second vertically disposed apertures are in substantial alignment with one another wherein a leading end of the first horizontally disposed wale and a leading end of the second horizontally disposed wale are oriented in substantially perpendicular fashion to one another and in relative proximity so that the horizontally extending flange of the first end-cap and the horizontally extending flange of the second end-cap overlap when the first and second vertically disposed apertures are substantially aligned with one another to permit the locking pin to be slideably received therein securing the apparatus together.

8 Claims, 3 Drawing Sheets

BEAM JOINING CAP FOR TRENCH SHIELD

FIELD OF INVENTION

The present invention relates generally to safety enclosures for excavations, and more particularly to an apparatus for joining the wales of a shoring system.

BACKGROUND OF THE INVENTION

When excavating a site for construction, calculable dangers exist to workers that are dependent on the design and construction of the shield system. Regulations promulgated by the United States Department of Labor, Occupational Safety & Health Administration (herein "OSHA") under 29 C.F.R. §1926.650 defines a "shield system" as:

> a structure that is able to withstand the forces imposed on it by a cave-in and thereby protect employees within the structure. Shields can be permanent structures or can be designed to be portable and moved along as work progresses. Additionally, shields can be either premanufactured or job-built in accordance with §2936.653(c) or (c)(4).

In one type of excavation procedure, typically used to install and replace petroleum tanks, a trench is dug around the perimeter of the excavation site and steel H-beams are placed into the trench. The beams are also known as "wales" which are placed parallel to the excavation face and whose sides bear against the vertical members of a shoring system or the earth. The wales are welded together to form a substantially rigid rectangle around the perimeter. Corrugated shield panels, also known as "uprights," are the vertical members of a trench shoring system and are placed in contact with the earth and usually positioned so that individual members do not contact each other. However, uprights may be in contact with or interconnected to each other, which is known as "sheeting." The uprights are placed on the outside periphery of the substantially rigid rectangle and are vertically driven into the ground. A support means is attached to each corner of the substantially rigid rectangle and ground beneath the wales is subsequently excavated thereby leaving the wales suspended at each comer of the substantially rigid rectangle by the support means. The support means typically comprises a chain link or heavy cable. Once work is completed within the excavation site, the wales must be welded apart and removed from the construction area.

However, repeated welding to join and cut the wales may cause structural faults in the wales and calculating the force that a weld can resist is difficult. Welding introduces safety hazards inherent in the procedure which are further compounded when working around legacy petroleum tanks. Lastly, welding is a specialized skill that requires expendable resources, equipment, and time.

Consequently, there is a need in the art for an apparatus for excavations that insures the strength of the shield system to protect workers against cave-ins.

There is a further need in the art for an apparatus to interconnect existing wales in a shield system without the need for welding.

There is a further need in the art for an apparatus that alleviates the need to weld the wales together in the shield system described above.

There is a further need in the art for an apparatus that requires a low amount of skill and training to operate safely and efficiently.

There is a further need in the art for an apparatus that does not degrade the structural integrity of the wales after repeated use.

There is a further need in the art for an apparatus that may be reused without diminution of effectiveness in excavations.

However, in view of the prior art in at the time the present invention was made, it was not obvious to those of ordinary skill in the pertinent art how the identified needs could be fulfilled.

SUMMARY OF THE INVENTION

Generally described, the present invention provides an apparatus for joining at least two or more wales of a shoring system comprising a first substantially rigid end-cap adapted to enclose an end of a first horizontally disposed wale, the first end-cap having a horizontally extending flange with a first vertically disposed aperture cut there through, a second substantially rigid end-cap adapted to enclose an end of a second horizontally disposed wale, the second end-cap having a horizontally extending flange with a second vertically disposed aperture cut there through of substantially the same diameter of the first vertically disposed aperture, a locking pin dimensioned to be slideably received by the first and second vertically disposed apertures when the first and second vertically disposed apertures are in substantial alignment with one another wherein a leading end of the first horizontally disposed wale and a leading end of the second horizontally disposed wale are oriented in substantially perpendicular fashion to one another and in relative proximity so that the horizontally extending flange of the first end-cap and the horizontally extending flange of the second end-cap overlap when the first and second vertically disposed apertures are substantially aligned with one another to permit the locking pin to be slideably received therein securing the apparatus together.

While the initial placement of the wales is achieved by digging trenches in which the wales rest, subsequent excavation often requires the wales to be suspended by heavy link chain or cable. Accordingly, a preferred embodiment of the invention further comprises a suspension interface on the first and second end-caps adapted to receive a support means for suspending the wales. The suspension interface is preferably a substantially rigid half-loop having an aperture through which the heavy link chain or cable is threadably received.

To further strength the interlocking feature of the invention, a plurality of vertically disposed apertures may be cut through the horizontally extending flanges wherein at least one or more pins may be selectively received through the horizontally extending flanges when in overlapping position.

Accordingly, it is an object of the present invention to provide an apparatus for excavations that insures the strength of the shield system to protect workers against cave-ins.

It is another object of the present invention to provide an apparatus that alleviates the need to weld the wales together in the shield system described above.

It is another object of the present invention to provide an apparatus that requires a low amount of skill and training to operate safely and efficiently.

It is another object of the present invention to provide an apparatus that does not degrade the structural integrity of the wales after repeated use.

It is another object of the present invention to provide an apparatus which may be reused without diminution of effectiveness in excavations.

An advantage of the invention is that welding is no longer needed to join the wales together. This reduces the risk of fire or explosion, particularly around petroleum tanks.

Another advantage of the invention is that the joining of the wales does not require special skill, training, or protective equipment as needed for welding.

Another advantage of the invention is that the joining of the wales by use of the apparatus does not degrade the structural integrity of the wales after repeated use.

Another advantage of the invention is that the end caps may be reused.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
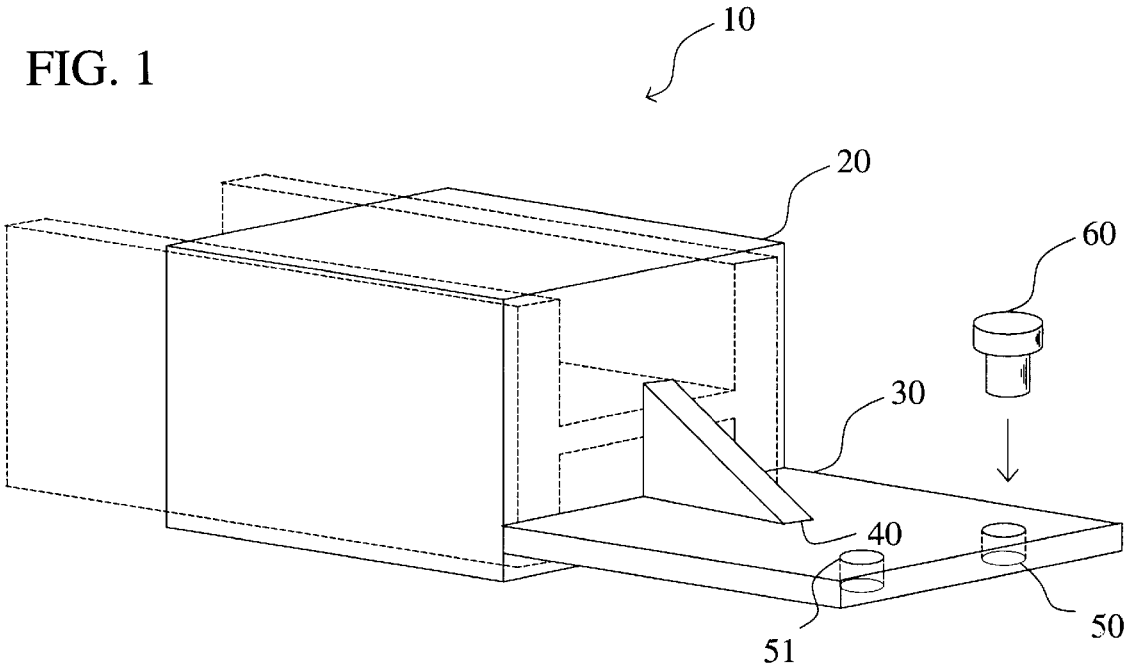
FIG. 1 is an elevated, isometric view of a preferred embodiment of the end cap structure enclosing an H-beam according to the invention.
Figure 2:
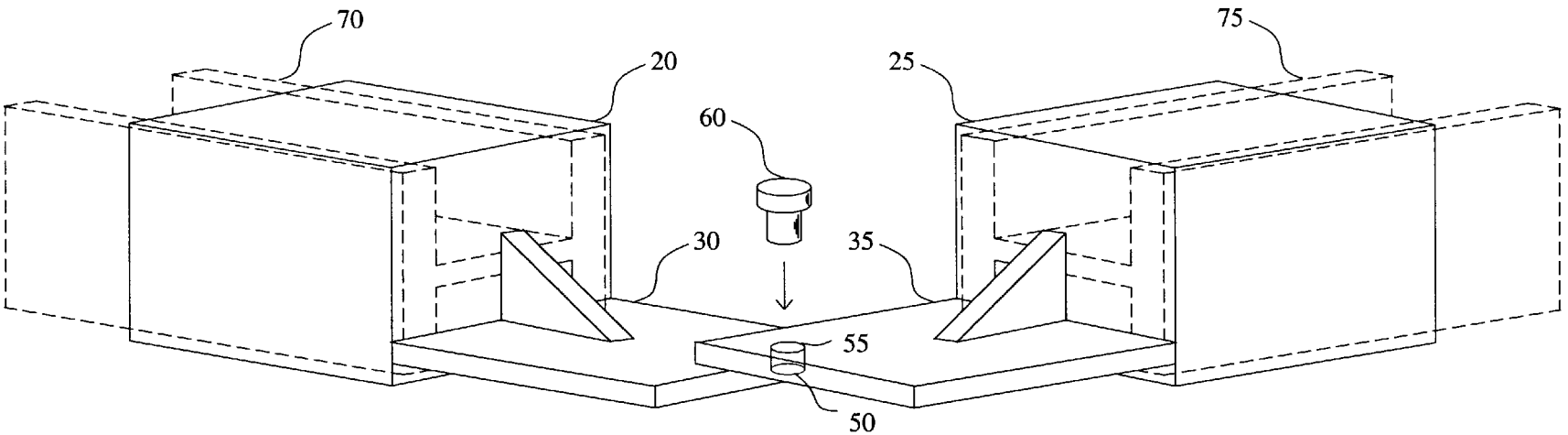
FIG. 2 is an elevated, isometric view of a preferred embodiment of two end cap structures enclosing H-beams and joined in substantially perpendicular orientation to each other according to the invention.

Referring initially to FIG. 1, it will there be seen that an illustrative embodiment of the present invention is denoted by the reference number 10 as a whole. A first substantially rigid end-cap 20 is adapted to engage an end of a first horizontally disposed wale 70, the first end-cap having a horizontally extending flange 30 with a first vertically disposed aperture 50 cut there through. Referring to FIG. 2, a second substantially rigid end-cap 25 is adapted to engage an end of a second horizontally disposed wale 75, the second end-cap 25 has a horizontally extending flange 35 with a second vertically disposed aperture 55 cut there through of substantially the same diameter of the first vertically disposed aperture 50, a locking pin 60 dimensioned to be slideably received by the first and second vertically disposed apertures when the first and second vertically disposed apertures are in substantial alignment with one another wherein a leading end of the first horizontally disposed wale 70 and a leading end of the second horizontally disposed wale 75 are oriented in substantially perpendicular fashion to one another and in relative proximity so that the horizontally extending flange of the first end-cap 20 and the horizontally extending flange of the second end-cap 25 overlap when the first and second vertically disposed apertures are substantially aligned with one another to permit the locking pin 60 to be slideably received therein securing the apparatus together.

Figure 3:
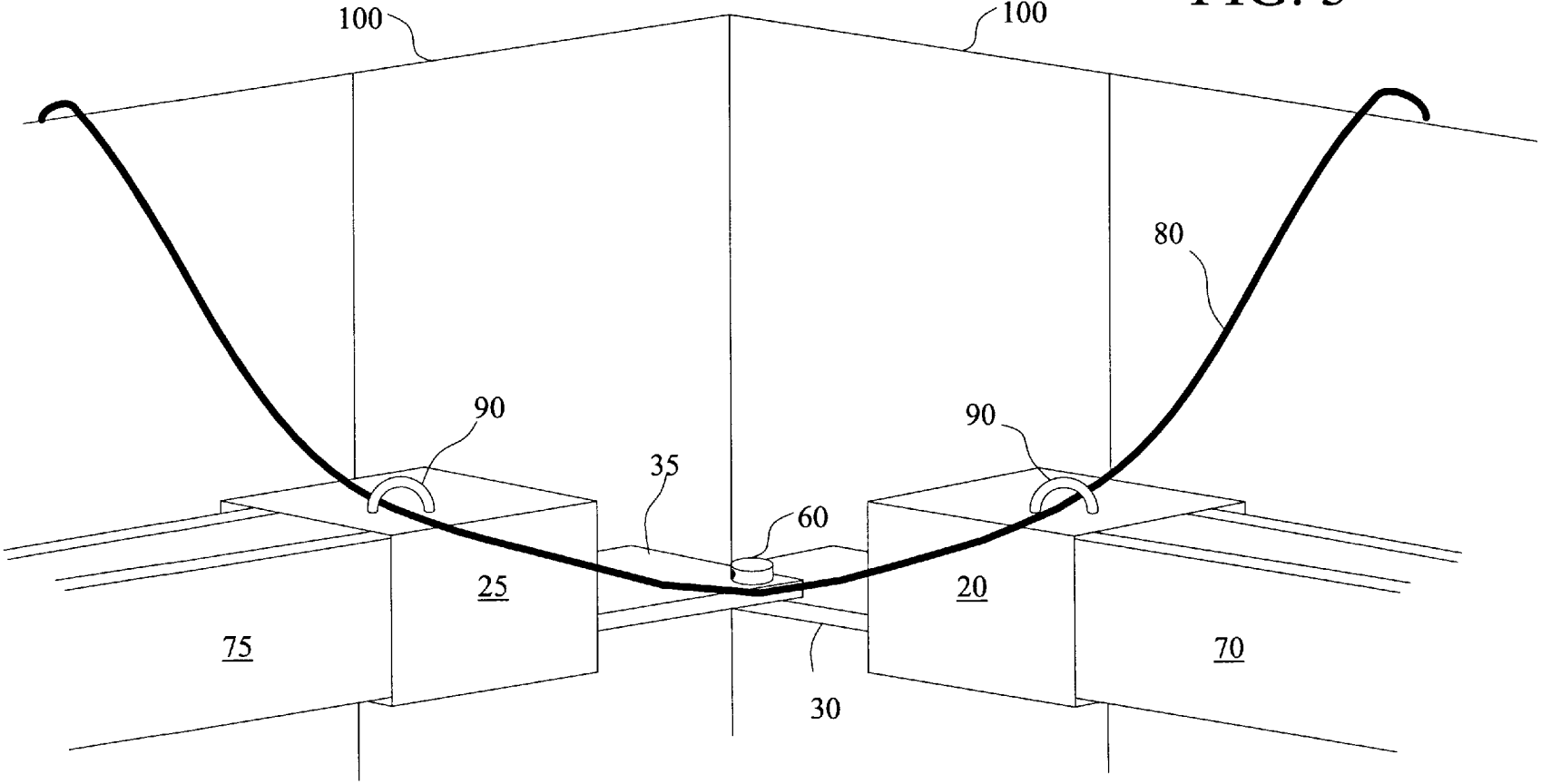
FIG. 3 is an elevated, isometric view of two wales joined in substantially perpendicular orientation and suspended against the uprights of an excavation site.

Referring the FIG. 3, the initial placement of the wales is achieved by digging trenches in which the wales rest. Subsequent excavation often requires the wales to be suspended by a support means 80 against the uprights 100. The support means 80 may comprise a heavy link chain or cable. Accordingly, a preferred embodiment of the invention further comprises a suspension interface 90 on the first and second end-caps adapted to receive a support means for suspending the wales. The suspension interface is preferably a substantially rigid half-loop having an aperture through which the heavy link chain or cable is threadably received.

To further strength the interlocking feature of the invention, a plurality of vertically disposed apertures may be cut through the horizontally extending flanges wherein at least one or more pins may be selectively received through the horizontally extending flanges when in overlapping position.

It will be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described,

What is claimed is:

1. An apparatus for joining at least two wales of a shoring system comprising (a) a first substantially rigid end-cap adapted to enclose an end of a first horizontally disposed wale, said first end-cap having a horizontally extending flange with a first vertically disposed aperture cut there through;

(b) a second substantially rigid end-cap adapted to enclose an end of a second horizontally disposed wale, said second end-cap having a horizontally extending flange with a second vertically disposed aperture cut there through of substantially the same diameter of said first vertically disposed aperture;

(c) a locking pin dimensioned to be slideably received by said first and second vertically disposed apertures when said first and second vertically disposed apertures are in substantial alignment with one another;

wherein a leading end of said first horizontally disposed wale and a leading end of said second horizontally disposed wale are oriented in substantially perpendicular fashion to one another and in relative proximity so that said horizontally extending flange of said first end-cap and said horizontally extending flange of said second end-cap overlap when said first and second vertically disposed apertures are substantially aligned with one another to permit said locking pin to be slideably received therein securing said apparatus together.

2. The apparatus of claim 1, further comprising a suspension interface on said first and second end-caps adapted to receive a support means for suspending said wales.

3. The apparatus of claim 2, wherein said suspension interface on said first and second end-caps comprises a substantially rigid half-loop.

4. The apparatus of claim 1, comprising a plurality of vertically disposed apertures cut through said horizontally extending flanges wherein at least one or more pins may be selectively received through said apertures of said horizontally extending flanges when said horizontally extending flanges are in overlapping position.

5. An apparatus for joining at least two wales of a shoring system comprising:

(a) a first substantially rigid end-cap adapted to engage an end of a horizontally disposed, fixed length wale, said first end-cap having a horizontally extending flange with a first vertically disposed aperture cut there through;

(b) a second substantially rigid end-cap adapted to engage an end of a second horizontally disposed, fixed length wale, said second end-cap having a horizontally extending flange with a second vertically disposed aperture cut there through of substantially the same diameter of said first vertically disposed aperture;

(c) a locking pin dimensioned to be slideably received by said first and second vertically disposed apertures when said first and second vertically disposed apertures are in substantial alignment with one another;

wherein said first horizontally disposed, fixed length wale and said second horizontally disposed, fixed length wale are oriented in substantially perpendicular fashion to one another and in relative proximity to one another so that said horizontally extending flange of said first end-cap and said horizontally extending flange of said second end-cap overlap when said first and second vertically disposed apertures are substantially aligned with one another to permit said locking pin to be slideably received therein securing said apparatus together whereby said first and second wales, when respectively capped with said first and second end caps, are interconnected in the absence of welding.

6. The apparatus of claim 5, further comprising a suspension interface on said first and second end-caps adapted to receive a support means for suspending said wales.

7. The apparatus of claim 6, wherein said suspension interface on said first and second end-caps comprises a substantially rigid half-loop.

8. The apparatus of claim 5, further comprising a plurality of vertically disposed apertures cut through said horizontally extending flanges wherein at least one or more pins may be selectively received through said apertures of said horizontally extending flanges when said horizontally extending flanges are in overlapping position.

* * * * *